US007764156B2

(12) United States Patent
Marrécau et al.

(10) Patent No.: US 7,764,156 B2
(45) Date of Patent: Jul. 27, 2010

(54) MAGNETIC FLUX RETURN PATH WITH COLLATED BANDS OF WIRE

(75) Inventors: Willy Marrécau, Rome, GA (US); Joëlle Stockemer, Meise (BE)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 12/285,249

(22) Filed: Sep. 30, 2008

(65) Prior Publication Data

US 2009/0094819 A1 Apr. 16, 2009

Related U.S. Application Data

(63) Continuation of application No. PCT/EP2007/052113, filed on Mar. 7, 2007.

(30) Foreign Application Priority Data

Mar. 30, 2006 (EP) ..... 06075829

(51) Int. Cl.
*H01F 17/00* (2006.01)
*H01F 27/24* (2006.01)

(52) U.S. Cl. ..... 336/177; 336/212

(58) Field of Classification Search ..... 336/222, 336/177

See application file for complete search history.

(56) References Cited

U.S. PATENT DOCUMENTS

| | | | | |
|---|---|---|---|---|
| 3,350,670 | A | 10/1967 | Strauch | |
| 4,364,013 | A * | 12/1982 | Castera et al. | 324/260 |
| 4,913,750 | A * | 4/1990 | Kakuno et al. | 148/304 |
| 5,803,396 | A | 9/1998 | Dewaele | |
| 6,954,129 | B2 * | 10/2005 | Buswell | 336/83 |

FOREIGN PATENT DOCUMENTS

| | | | |
|---|---|---|---|
| BE | 796955 | A2 | 9/1973 |
| CA | 1309149 | | 10/1992 |
| DE | 199 37 073 | A1 | 2/2001 |
| GB | 470751 | | 8/1937 |
| JP | 58162015 | | 9/1983 |
| JP | 2001/059164 | | 3/2001 |
| JP | 2004/363512 | | 12/2004 |
| WO | WO 91/09442 | | 6/1991 |
| WO | WO 96/26881 | | 9/1996 |
| WO | WO 00/44006 | | 7/2000 |

OTHER PUBLICATIONS

International Search Report for international application No. PCT/EP2007/052113, filed Mar. 7, 2007, and dated 26 Jul. 27, 2007, 3 pages.

"Kenas/Office Supplies" from www.kenascy.com/en/go/office-supplies, © 2006-2009, undated, (1)one page.

* cited by examiner

*Primary Examiner*—Anh T Mai
(74) *Attorney, Agent, or Firm*—Shlesinger, Arkwright & Garvey LLP

(57) ABSTRACT

Method of forming a magnetic core or part of a magnetic core including several layers of windings of magnetic wire in a very compact configuration, and the core or part of core is formed by winding several layers of a collated band of wires side by side until desired number of layers of core or part of core is obtained. Method includes forming magnetic core or magnetic flux return path or part of magnetic core including several layers of windings of magnetic wire in compact configuration; core or part of core being formed by winding several layers of a collated band of wires side by side until reaching desired number of layers of the core or part of the core. Magnetic core or magnetic flux return path includes several layers of windings of magnetic wire in compact configuration; part of layers of windings being formed by collated band of wires.

9 Claims, 2 Drawing Sheets

MAGNETIC FLUX RETURN PATH WITH COLLATED BANDS OF WIRE

CROSS-REFERENCE TO RELATED APPLICATIONS

This application is a continuation of application no. PCT/EP2007/052113, filed Mar. 7, 2007, which claims the priority of European patent application no. 06075829.9, filed Mar. 30, 2006, and each of which is incorporated herein by reference.

FIELD OF THE INVENTION

This invention relates to a method of forming a magnetic core or part of a magnetic core comprising several layers of windings of magnetic wire in a closed compact configuration.

BACKGROUND ART

By magnetic wire is understood magnetically conducting wire or wire with magnetic properties, particularly with a high magnetic permeability, such as used e.g. for manufacturing a magnetic flux return path, such as the magnetic core of transformers, induction coils, electric motors, et cetera.

The idea of replacing stacked sheets or plates of the magnetic core of a transformer by magnetic wires is already known. This is e.g., described in the following patent documents: Canadian patent no. 1309149, German publication DE 19937073A1; International patent publication WO 00/44006 and Japanese publication 2004-363512 and International patent publication WO 91/09442.

The use of magnetic wires instead of magnetic sheets or plates for manufacturing magnetic cores has many advantages, as already described in the above-mentioned patent documents.

As particularly mentioned in WO 91/09442, some important advantages of utilizing magnetic wires instead of magnetic sheets or plates are obtained by the fact that the layers of magnetic material wire can be constructed of any wire geometry as for example square, flat, round, oval, triangular or other desirable cross sections to allow various compact packing characteristics in the layers of the magnetic core for different applications.

Another important feature, clearly described in WO 91/09442, is the use of the standard coil winding techniques for manufacturing the magnetic core forming the magnetic flux return path of a transformer. These standard coil winding techniques consist in forming the magnetic core or magnetic flux return path by winding a plurality of separate or discrete windings of magnetic material wire in closely adjacent relationship to form at least one layer of the magnetic core. This is a rather cumbersome and expensive operation for forming the magnetic core because each layer of the core is formed by winding a great number of adjacent, separate windings of the magnetic wire closely to each other. Moreover, the magnetic core, built up in this way by all separate, individual magnetic wires does not form a stable packed configuration.

OBJECTS AND SUMMARY OF THE INVENTION

An object of the invention is therefore to provide a new method for forming a magnetic core or part of a magnetic core comprising several layers of windings of magnetic wire in a very closed compact configuration, whereby the standard winding techniques can be used, but whereby the manufacturing cost is seriously decreased.

Another object of the invention is to overcome the drawbacks of the prior art.

Another important object of the invention is to obtain a very closed compact magnetic wire core, whereby the several layers of the magnetic wire form a very stable packed configuration, which layers of windings maintain the compact configuration during further handling of this compact magnetic wire core.

According to the invention, the method of forming a magnetic wire core is characterized in that the wire core or at least a part of the wire core is formed by winding several layers of a collated band of wires side by side until the desired number of layers of the wire core or part of the wire core is obtained.

The magnetic wire core comprising several layers of windings of magnetic wire in a very closed compact configuration is according to the invention, characterized in, that all the layers or at least a part of the layers are formed by a collated band of adjacent wires.

Other embodiments of the invention are mentioned in the dependent claims.

Collated bands of adjacent wires, as such, whereby the adjacent individual wires are preferably glued to each other, are already long known, as e.g., described in the European patent 0812292B1 and Belgian patent 796.955 of applicant NV BEKAERT SA.

Relative terms such as up, down, left, and right are for convenience only and are not intended to be limiting.

BRIEF DESCRIPTION OF THE DRAWINGS

The invention will now be described in more detail by reference to the accompanying drawing, in which.

DETAILED DESCRIPTION OF THE INVENTION

Figure 1:
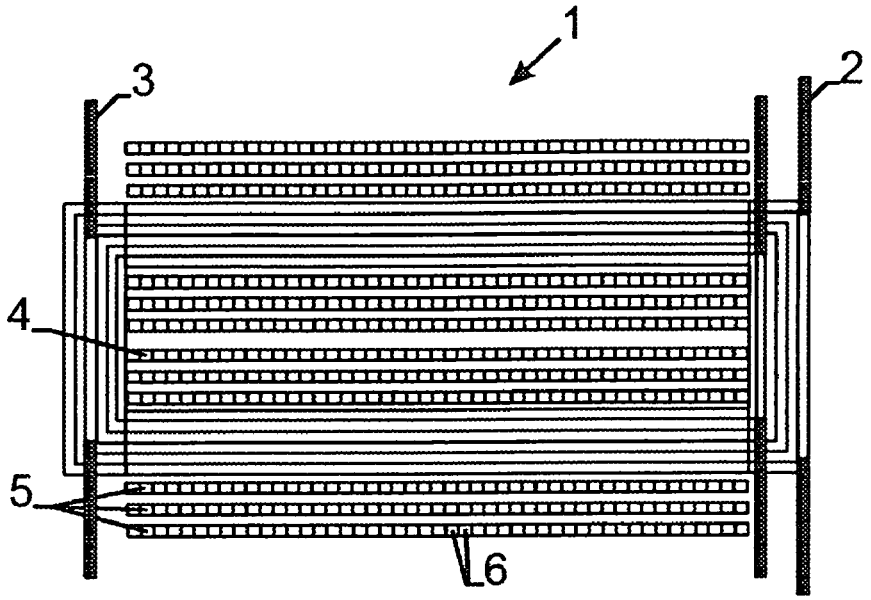
FIG. 1 shows a schematic cross section through a transformer comprising a core wire according to the invention.

Turning now to FIG. 1, a schematic longitudinal cross section through a transformer 1 is shown. The transformer 1 comprises e.g., the primary winding 2, the secondary windings 3 and the magnetic core 4. As can be seen from FIG. 1, the whole magnetic core 4 is built up by several superimposed layers 5 of adjacent windings of magnetic wire 6, whereby the cross section of each wire 6 is substantially rectangular. It is clear, that the compactness of the formed magnetic wire core 4 is very high thanks to the use of such wires 6 with a substantially rectangular cross section. However, by rolling or drawing the wires 6 into a rectangular shape, the edges of the wire are radiused. The higher the ratio width over thickness of each wire cross section is, the less rounding off of the wire edges and thereby the higher possible compactness is obtained.

Figure 2:
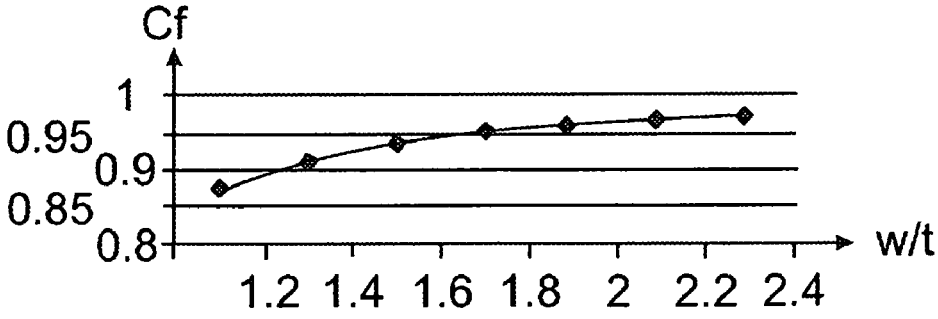
FIG. 2 shows a graph illustrating the relation between the dimensions (width/thickness) of a rectangular cross section wire and the conversion factor (degree of potential compactness)

FIG. 2 shows a graph illustrating the relation between the dimensions (width over thickness) of a rectangular cross section wire 6 and the conversion factor. The conversion factor is a degree for potential compactness. Taking e.g. a wire 6 with cross section of 0.51 mm×0.58 mm gives a conversion factor of 0.9. It means a compactness degree of 90%.

The magnetic core 4 according to the invention, shown in FIG. 1, is completely formed by winding several layers 5 of collated band of wires side by side until the desired number of core layers is obtained. The use of a collated band of wires allows for an excellent compactness of the formed wire core, as well as for a high coiling efficiency. The fact that many wires are used instead of one single wire gives many advantages over the known prior art magnetic wire cores. The width of the collated band can e.g. vary from 100 to 200 mm and is completely defined by the dimensions of the used magnetic wire and the magnetic wire core to be manufactured. The band consists e.g. of more than 200 magnetic steel wires placed next to each other, whereby the steel wires present an almost rectangular cross section. The wires 6 are glued to each other. The glue of the collated band of wires is preferably a non-conductive glue. As already mentioned in the preamble, such a band or strip of collated steel wires as such is generally known but not in the context of a magnetic core.

From a manufacturing point of view, it is now possible to treat many wires (e.g. up to 200 and more) at the same time which reduces seriously the cost of manufacture. Once the collated band of wires is produced and wound on a spool, it becomes very efficient to prepare the magnetic cores 4 by putting several bands side by side to make up a magnetic wire core 4 according to the invention. To use these magnetic wire cores 4 as such for torroidal configurations or to be cut into two parts to insert the primary and secondary windings are possible regardless of design and can be based on whatever the most economical way to construct the transformer. It is also possible to anneal the whole spool, once the collated band of wires is wound on the spool.

Another very important advantage of the magnetic wire cores 4 made up of collated band of magnetic wires consists in the fact that the formed magnetic wire core is very stable. It means that the magnetic wire core 4 according to the invention maintains its compact stacked configuration during further use or further transforming of the magnetic wire core, e.g. during the application of the primary windings 2 and secondary windings 3 around the magnetic wire core 4. As already mentioned, it is sometimes necessary to cut the compact wire core in two parts for applying these windings 2 and 3. In all these cases, it is very advantageous to have a very stable configuration of the formed steel wire core 4.

It is also clear, that it is possible to use several collated bands of wires with smaller width instead of one collated band with the correct width of the magnetic wire core to be manufactured. Moreover, it is also possible to form only a part of the magnetic core by means of a collated band of wires, whereby the remaining parts of the core to be formed are filled up by layers of individual wires.

Figure 3:
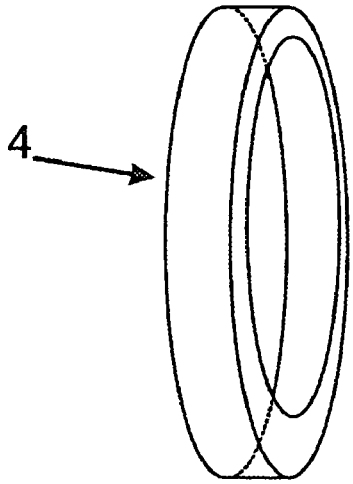
FIG. 3 shows a schematic perspective view of a special wire core with an oval configuration.

FIG. 3 shows a schematic perspective view of a special wire core 4 with an oval configuration or with a long length and a small width. The wire core is built up by means of several layers 5 of collated bands. This magnetic wire core configuration can be used as magnetic core for special transformer designs.

Figure 4:
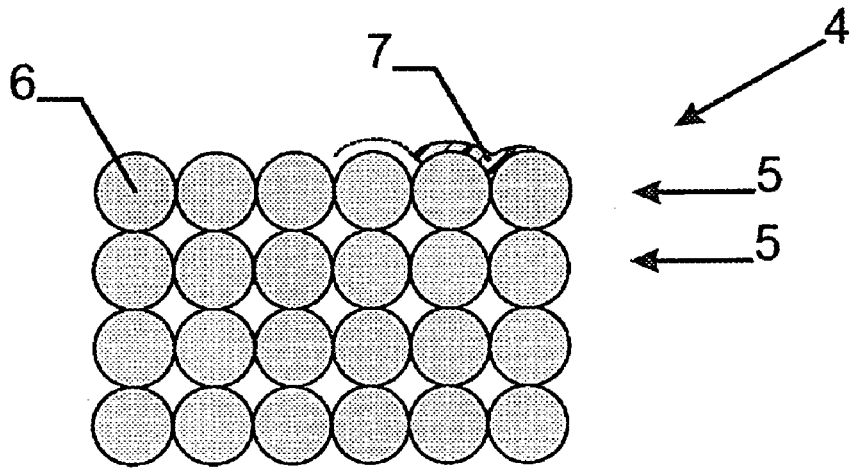
FIG. 4 and FIG. 5 both show a cross-section of a wire core according to the invention.

FIG. 4 shows a cross-section of a wire core 4. Wire core 4 has several layers 5 of collated band and each layer 5 has a plurality of individual wires 6, one very close to or in contact with another. Glue or adhesive 7 bonds adjacent wires together. Some glue or adhesive 7 may or not be present between the individual wires 6.

Figure 5:
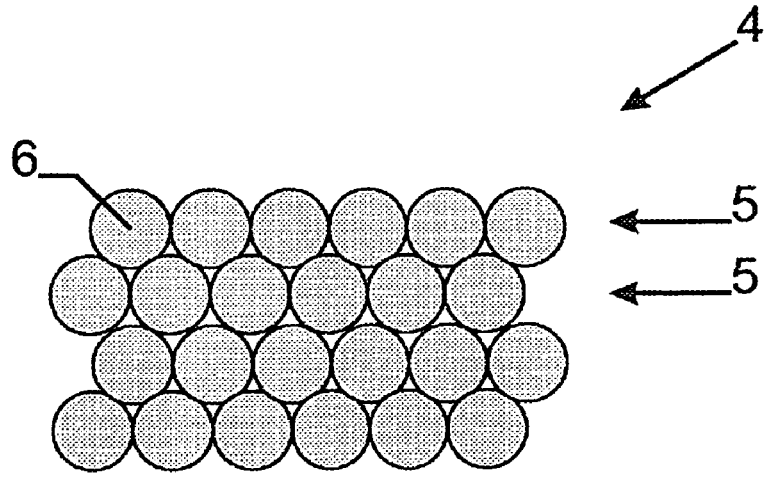

In case round wires 6 are used, FIG. 5 shows an embodiment where an increased filling degree can be obtained. This increased filling degree is obtained by shifting a next collated band half a pitch (=half a diameter of a wire 6) so that wires are lodged in the "valleys" and a very compact configuration of FIG. 5 is obtained.

With respect to the diameter of the magnetic wire, this is defined as the diameter of a round wire with the same cross-section. This diameter may range between 0.05 and 1.00 mm, e.g. between 0.05 mm and 0.50 mm.

With respect to the metal composition of the magnetic wire, JP2004363352 discloses a preferable composition along following lines: total contents of C, S, O and N are below 0.025% by weight, and one or more elements of the following selection:

Si between 0.01% and 8.0% by weight;
Mn up to 3.0% by weight;
P lower than 0.2% by weight;
Al up to 2.0% by weight;
Cu up to 2.0% by weight;
Ni up to 5.0% by weight;
Cr between 0.01% to 15% by weight.

This composition is excellent in wire drawability and in giving good magnetic properties at high frequencies.

Other plain carbon steel compositions such as a steel composition with a very low carbon content without explicit additions of other materials (except for unavoidable impurities) may form suitable and cheap alternatives.

Obviously other compositions for the magnetic wire are suitable. A suitable alloy composition responds to the general formula:

NiaFebCrcCodCueMofMngPhNbiBjVkSilCm, where a to m represent integers.

More particular alloy compositions have 52 to 85% of nickel (Ni) and varying amounts of other components.

An example of a good working alloy composition is: 80.00% Ni, 4.20% Mo, 0.50% Mn, 0.35% Si; 0.02% C, the balance being Fe.

Other typical compositions are:

Ni82Fe14Mo3Mn1
Ni79Fe16Mo4Mn1
Ni70Fe11Cu12Mo2Mn5

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

The invention claimed is:

1. A method, comprising:

a) forming a magnetic core or magnetic flux return path or part of a magnetic core including several layers of windings of magnetic wire in a compact configuration; and b) the core or part of the core being formed by winding several layers of a collated band of magnetic wires side by side until the desired number of layers of the core or part of the core is obtained.

2. A magnetic core or magnetic flux return path, comprising:

a) several layers of windings of magnetic wire in a compact configuration; and b) at least a part of the several layers of windings being formed by a collated band of magnetic wires.

3. A magnetic core according to claim 2, wherein:

a) the collated band of magnetic wires includes a non-conductive glue.

4. A magnetic core according to claim 3, wherein:

a) the magnetic wires of the collated band are annealed.

5. A magnetic core according to claim 2, wherein:

a) the magnetic wires of the collated band are annealed wires.

6. A magnetic core or magnetic flux return path, comprising:

a) several layers of windings of magnetic wire in a compact configuration; and b) at least a part of the several layers of windings being formed by a collated band of round magnetic wires.

7. A magnetic core according to claim 6, wherein:

a) the collated band of magnetic wires includes a non-conductive glue.

8. A magnetic core according to claim 7, wherein:

a) the magnetic wires of the collated band are annealed.

9. A magnetic core according to claim 6, wherein:

a) the magnetic wires of the collated band are annealed.

* * * * *